US006270271B1

(12) United States Patent
Fujiwara

(10) Patent No.: US 6,270,271 B1
(45) **Date of Patent: *Aug. 7, 2001**

(54) PRINTER FOR PORTABLE INFORMATION PROCESSOR

(75) Inventor: Hitoshi Fujiwara, Shiojiri (JP)

(73) Assignees: F&F Limited; Seiko Instruments Inc., Nagano, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/185,613

(22) Filed: Nov. 4, 1998

(30) Foreign Application Priority Data

Nov. 7, 1997 (JP) ..... 9-305308

(51) Int. Cl.[7] ..... B41J 3/36; B41J 29/02

(52) U.S. Cl. ..... 400/693; 400/692; 400/88; 400/120.01

(58) Field of Search ..... 400/120.01, 120.02, 400/120.03, 120.04, 120.05, 120.06, 120.07, 120.08, 120.09, 120.1, 120.11, 120.12, 120.13, 120.14, 120.15, 120.16, 120.17, 120.18, 88, 682, 685, 691, 692, 693; 235/472.01; 361/686

(56) References Cited

U.S. PATENT DOCUMENTS 3,955,663 * 5/1976 Ecker ..... 400/88
4,433,925 * 2/1984 Fujiwara et al. ..... 400/88
4,839,837 * 6/1989 Chang ..... 364/708
5,006,002 * 4/1991 Brodbeck ..... 400/88
5,186,557 * 2/1993 Fushimi ..... 400/693
5,209,583 * 5/1993 Lewis et al. ..... 400/88
5,213,427 * 5/1993 Grosse et al. ..... 400/680
5,353,360 * 10/1994 Obara ..... 400/693
5,364,196 * 11/1994 Baitz et al. ..... 400/691
5,443,320 * 8/1995 Agata et al. ..... 400/715
5,456,540 * 10/1995 Jeutter ..... 400/634
5,499,043 * 3/1996 Osaka ..... 400/691
5,602,650 * 2/1997 Tamura et al. ..... 358/400
5,764,475 * 6/1998 LeVander ..... 361/683
5,816,725 * 10/1998 Sherman et al. ..... 400/692

* cited by examiner

*Primary Examiner*—John S. Hilten
*Assistant Examiner*—Leslie J. Grohusky
(74) *Attorney, Agent, or Firm*—Blank Rome Comisky & McCauley, LLP

(57) ABSTRACT

A printer including a portable information processing portion located on the face of the printer, a paper accomodating portion located on the back of the information processing portion and capable of accomodating thermosensible printing sheets of standardized size, and a printing mechanism portion located adjacent to a side of the information processing portion is provided. With such a structure, a printer which allows for a large printing area while being as almost the same size of PDA and is suitable for portable use can be provided. Moreover, by employing a thermal head for printing on the thermosensible sheets, a space required for consumables such as ink is eliminated. As a result, a practically portable printer can be provided.

14 Claims, 2 Drawing Sheets

PRINTER FOR PORTABLE INFORMATION PROCESSOR

BACKGROUND OF THE INVENTION

1. Technical Field

The present invention relates to a printer for printing an image such as characters or graphic data on printing paper.

2. Description of the Related Art

Personal computers are becoming increasingly smaller, and portable mobile computers such as a PDA (Personal Data Acquisition/Personal Digital Assistance) have been put into practical use. A variety of types of such portable mobile computers are commercially available.

A printer is one of the main peripheral units of the personal computer. However, a printer, which is desirable as an accessory of the PDA, has not been provided. A small printer using roll paper is commercially available for apparatuses such as an electronic calculator. However, a printing area or print out size of such a printer is so small. Therefore, if such a printer is used for the PDA, the screen of the PDA is so large compared to the printing area that printed screen on the printing paper becomes too small to read. On the other hand, a printer using, for example, A4-size printing paper is too much larger than the PDA, and therefore, is not suitable for portable use.

It is therefore an object of the present invention to provide a printer having substantially the same size as that of the PDA, achieving a large printing area, and being suitable for portable use. It is another object of the present invention to provide a printer which can be carried by an individual user together with a mobile computer and can be used as personal notes like a scratch pad.

SUMMARY OF THE INVENTION

According to the present invention, a paper accommodating portion is provided on the back of a portable information processing portion (a information processor) such as a PDA, a printing mechanism portion is provided so as to be adjacent to a side of the information processing portion, in addition, the paper accomodating portion is capable of accommodating printing sheets of standardized size, such as size A6, B7 and others, which is substantially the same size as that of the PDA. Thus, a small, thin printer having substantially the same size as that of the portable information processor like PDA itself, capable of printing on the sheet which is larger than the display screen of the information processing portion, and capable of being integrally attached to the information processor can be provided. The printer according to the present invention comprises the portable information processing portion located on the face of the printer, the paper accommodating portion capable of accommodating a plurality of printing sheets of standardized size, and a printing mechanism portion located adjacent to the side of the information processing portion.

The printer of the present invention uses printing sheets of standardized size, that are cutforms having a prescribed size, instead of the roll paper. Accordingly, a plurality of sheets having a large printing area can be accommodated in the thin paper accommodating portion. Moreover, the paper accommodating portion is integrally located on the back of the portable information processing portion, whereby the printer capable of printing on the large printing paper can be provided without significant change in the size of the portable information processor. The printer of this invention can be provided either as an integral apparatus in which the information processing portion cannot be separated from the printer or as a docking station in which the information processing portion can be attached to and detached from the printer.

The printer of the present invention employs a thermal head for printing on thermosensible sheets, eliminating the need for ink, toner and the like. Therefore, a smaller printing mechanism portion can be obtained. Moreover, the printer of the present invention employs the combination of a pick-up roller, a platen roller having a printing-paper feeding function and a thermal head, whereby a further compact printing mechanism portion can be achieved. In addition, a motor for feeding and other function can be installed in the platen roller to compact the printing mechanism portion.

Many of the conventional small printers use the roll type thermosensible paper. However, the printer of the present invention employs printing sheets (thermosensible sheets) of standardized cutform. Therefore, paper is accommodated in a thin area and fed on a sheet-by-sheet basis. Using the printing sheets also eliminate disadvantages such as clogging and/or jamming with the printing paper which is caused by accumulation of tolerances of the paper feeding path. Hence, the paper feeding mechanism need not be so accurate as compared to the case of the printer using the roll paper. As a result, an inexpensive smaller printer that is less likely to be clogged with the printing paper can be realized.

In the paper accommodating portion located reverse of the printer, a cover, which can open and close, and be served as a part of a bottom housing, can be provided for realizing a cartridge-type paper accommodating portion. By this arrangement, the printing sheets can be sealed within the paper accommodating portion. Therefore, the printing paper can be free from being scattered damaged and/or soiled when the printer is carried by the user. The cover also, protects the thermosensible sheets from the heat of the sunlight, illumination or the like, whereby the thermosensible sheets can be desirably stored. Furthermore, a paper pressing member having a leaf-spring shape is provided on the inner surface of the cover. When the cover is closed, the printing sheets can be pressed against the pick-up roller by the paper-pressing member, whereby the printing sheets can be smoothly fed into the printing mechanism portion on a sheet-by-sheet basis.

The above-mentioned and other objects and advantages of the present invention will become apparent to those skilled in the art upon reading and understanding the following detailed description with reference to the accompanying figures.

DESCRIPTION OF THE PREFERRED EMBODIMENTS

Figure 1:
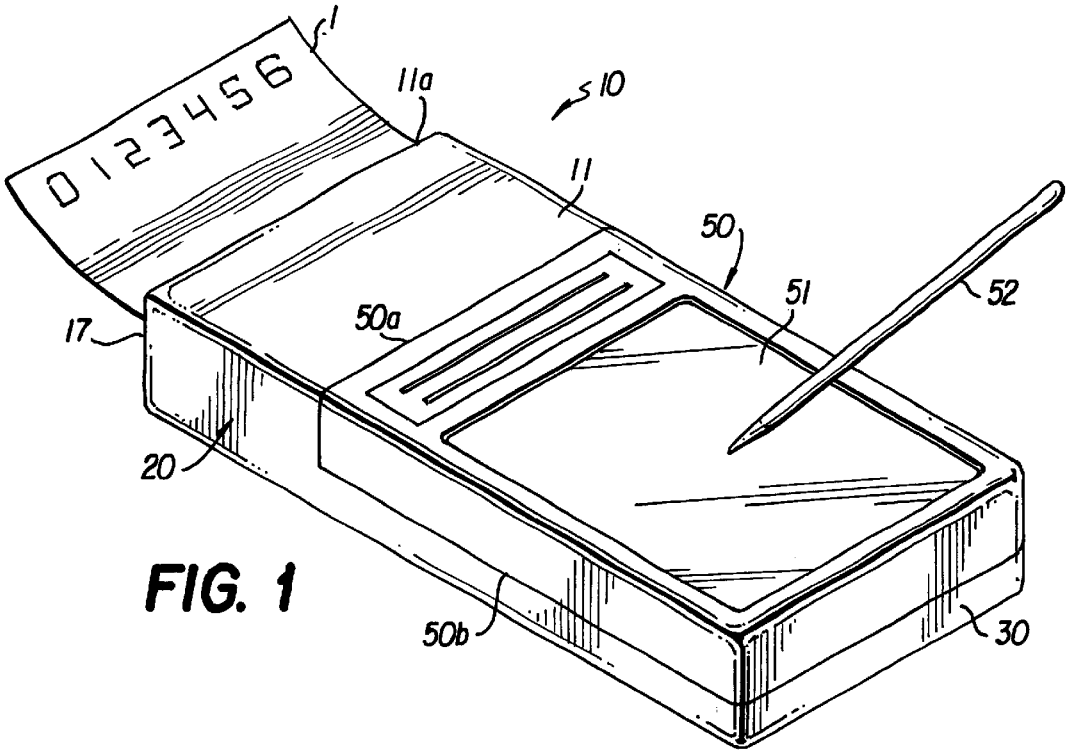
FIG. 1 is a schematic perspective view showing a printer according to the present invention.

Hereinafter, an embodiment of the present invention will be described with reference to the accompanying drawings. FIG. 1 schematically shows a printer 10 according to an embodiment of the present invention. The printer 10, as a whole, has a thin and rectangular shape. A PDA 50, a portable information processing terminal, is provided on the face (front) of the printer 10. A printing mechanism portion 20 is provided adjacent to a side 50*a* (on the left of the figure) of the PDA 50. Moreover, a paper accommodating portion 30 capable of accommodating a plurality of thermosensible sheet 1 of standardized size (shown in FIGS. 2 and 3) is provided on the back 50*b* of the PDA 50. The printing mechanism portion 20 and the paper accomodating portion 30 are integrally formed into a housing 11, and the PDA 50 is a portable processing portion that can be attached to and detached from the housing 11. Accordingly, when the PDA 50 is attached to the housing 11, the PDA 50, the printing mechanism portion 20 and the paper accomodating portion 30 can be handled as an integral apparatus having a rectangular shape that is operable as a single unit of printer 10. The printer 10 can be carried either with the PDA 50 being attached to the housing 11, or with the PDA 50 being detached therefrom.

The PDA 50 of the present embodiment has a liquid crystal display (LCD) for displaying information and a touch panel for inputting information. The LCD and the touch panel are provided in the central portion 51 of the PDA 50, and the touch panel is placed over the LCD. Accordingly, using a pen 52 on the LCD can input information and data. Applications including word processor, chart and calculation, electronic mail (e-mail) and browser are installed in the PDA 50, whereby the PDA 50 is a portable and small information processor that is suitable for management of personal schedule, data and others.

Figure 2:
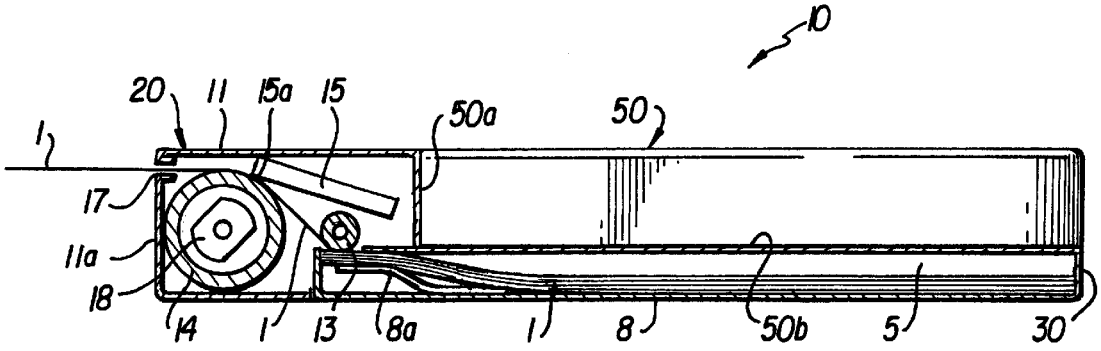
FIG. 2 is a schematic cross sectional view showing a structure of the printer of FIG. 1.

FIG. 2 schematically shows a mechanism of the printer 10 of the present embodiment. The printing mechanism portion 20 of the present embodiment includes a pick-up roller 13 for picking up a thermosensible sheet 1 from the paper accommodating portion 30, a platen roller 14 having a paper-feeding function, and a thermal head 15 serving as a printing head for the thermosensible sheet. The pick-up roller 13, the platen roller 14 and the thermal head 15 are accommodated in a thicker space of the thin housing 11 which is located adjacent to the side 50*a* of the PDA 50.

The paper accommodating portion 30 is located on the back 50*b* of the PDA 50, and is constituted by a thinner space of the housing 11 which horizontally extends along with the PDA 50 from the printing mechanism portion 20. The paper accommodating portion 30 is in the form of a thin, paper cassette (cartridge) 5 having a substantially rectangular shape. A plurality of thermosensible sheet 1 having substantially the same size as that of the PDA 50, for example thermosensible sheets cut into a size such as A6 or B7 can be accomodated in the paper accommodating portion 30.

The printing mechanism portion 20 of the printer 10 according to the present embodiment will now be described in more detail. In the printing mechanism portion 20, the thermal head 15 and the platen roller 14 are sequentially located in this order from the paper accomodating portion 30, that is, from the PDA 50. The pick-up roller 13 is provided a space under the thermal head 15 to be face onto the paper accommodating portion 30. The pick-up roller 13 feeds a thermosensible sheet 1 accommodated in the paper accommodating portion 30 into a printing area 15*a* of the thermal head 15, this printing area 15*a* faces and being contact with the platen roller 14. A driving motor 18 is provided inside the platen roller 14, whereby each of the platen roller 14 and the pick-up roller 13 can be rotated in an appropriate direction through an appropriate power transmission mechanism such as a gear string. Accordingly, by appropriately controlling a rotational direction of the motor 18, the sheet of thermosensible paper 1 can be rapidly fed into the printing portion 15*a* of the thermal head 15, or can be discharged from the printing mechanism portion 20 after being printed at a printing speed. The printed sheet 1 is fed into a discharge port 17 provided in a side 11*a* of the housing 11. Then, the printed sheet 1 is out from the discharge port 17 so as to the printed surface is upward (face up). Therefore, in this printer 10, users can see the printed surface from the front side (face) of the printer 10 easily when the sheet is out from the side of the PDA 50.

In the printing mechanism portion 20 of the present embodiment, the thermal head 15 and the pick-up roller 13 are vertically arranged and located lateral of the platen roller 14 so as to makes a compact arrangement. Also, the motor 18 is installed in the platen roller 14 to minimize the space of the printing mechanism portion 20. Moreover, since the thermosensible sheets 1 are used, printing can be conducted without using consumable supplies such as ink, ribbon or toner, which are required for the ink jet printers and laser printers. Accordingly, a space for such consumable materials is not required. As a result, the very small, thin printing mechanism portion 20 is provided adjacent to the side 50*a* of the PDA 50. Thus, the printing mechanism can be added to the PDA 50 without significant increase in the overall size of the printer 10.

Moreover, only the printing paper is required as consumable, whereby a small, thin and lightweight printer is obtained and maintenance for supplying consumable is not required for the printer. Therefore, the printer 10 of the present embodiment is suitable for portable use. Since a printed sheet of paper is discharged face up, the user can confirm printed matter so easily from the face (from the direction of PDA 50) of printer. Accordingly, the printing condition can be continuously verified, which makes the printer 10 more advantageous for use.

The printing mechanism portion 20 is located at the lateral side 50*a* of the PDA 20 and the platen roller 14 and thermal head 15 are so compactly arranged in the length direction (longer side) of the PDA 20. However, both the platen roller 14 and the thermal head 15 extend along the width direction (shorter side) of the PDA 50. Accordingly, the printing mechanism portion 20 is short in the length direction of the PDA 50, but allows for a printing area having substantially the name width as that of the PDA 50. As a result, the printer 10 can print the entire area of the sheets having substantially the same size as that of the PDA 50 in the paper accommodating portion 30. Namely, the thermosensible sheets 1 of, for example, size A6 or B7 (width: 91 mm; length: 128 mm), almost the same size of PDA 50 and larger enough for a portable printer, can be used and the printing area can be increased. Accordingly, the printer 10 of the present embodiment functions as a portable output apparatus which allows for a printing area large enough to print screen displayed on the LCD in the central portion 51 of the PDA 50 either with or without magnification.

Therefore, data which is input/output using the PDA 50, an e-mail displayed on the screen of the LCD in the central portion 51 of the PDA 50, hand-written notes on PDA 50, a document made by the word processor, and data on the browser can be completely and clearly printed out by the printer 10 with resolution which is substantially the same as or higher than that of the screen of the LCD in the central portion 51. As a result, by the printer 10 it becomes very easy to get a printed matter for various purposes such as verification of the date of submission and the date of storage and for personal notes.

Moreover, although the conventional small printers use roll-type thermosensible paper, the printer 10 of the present invention employs cutformed thermosensible sheet 1 of standardized size. Therefore, not only the space for accommodating the sheets becomes thin but also parts for paper feeding function need not be so accurate as compared to the conventional small printers. More specifically, in the case of the roll paper, the paper may gradually be shifted from the original paper feeding path, whereby the printer may finally be clogged or jammed with the paper. On the other hand, in the case of the printing sheets cut standardized size are fed on a sheet-by-sheet basis. Therefore, such shifting is not accumulated, whereby an inexpensive printer which is small and less likely to be clogged with paper can be provided.

Figure 3:
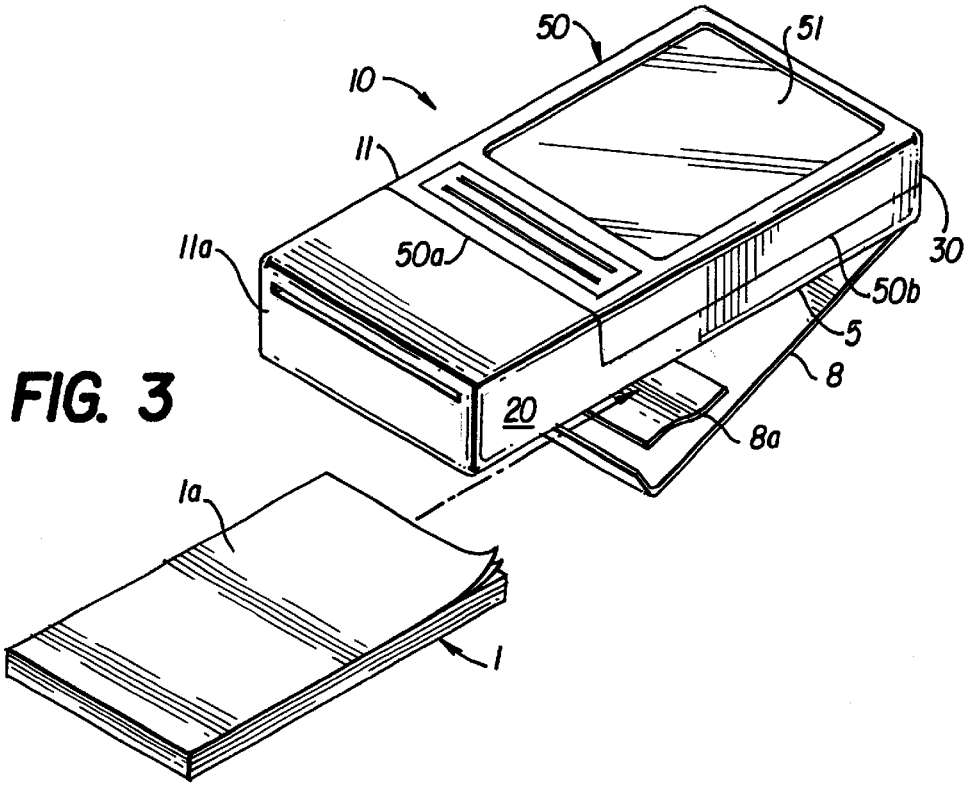
FIG. 3 is a diagram showing the printer of FIG. 1 with a cover of its paper accommodating portion being opened.

FIG. 3 shows how the thermosensible sheets 1 are accommodated in the paper accommodating portion of the printer 10 of the present embodiment. The bottom 8 of the printer 10 is a cover which can be pivotally opened and closed with respect to the main body of the printer 10 and covers the paper accommodating portion 30 of the housing 11. Therefore, paper can be supplied to the printer 10 by merely opening the cover 8 located at the bottom of the main body of the printer 10 and inserting the sheets of thermosensible paper 1 with their printing surfaces 1*a* directed upward, that is, directed toward the PDA 50. On the paper side of the cover 8, that is, on the inner side of the cover 8, a paper pressing member 8*a* having a leaf-spring shape for pressing paper is provided. Therefore, when the sheets of paper 1 are set into the paper accommodating portion 30 then the cover 8 is closed, the thermosensible sheets 1 are pressed against the pick-up roller 13 by the paper pressing member 8*a*. As a result, all of the thermosensible sheets 1 can be completely and smoothly fed into the printing mechanism portion 20 on a sheet-by-sheet basis.

Moreover, when the cover 8 is closed, the paper accommodating portion 30 is sealed. Accordingly, the sheets of paper 1 accommodated in the paper accommodating portion 30 are neither bent nor soiled, whereby the quality of the printing sheets 1 can be desirably maintained. Since the paper accommodating portion 30 has a cassette-like construction, thermosensible sheets 1 can be easily set in the printer 10 and can be fed to printing smoothly without clogging. Moreover, the printer 10 of the present embodiment can be carried without causing any damage to the sheets.

Figure 4:
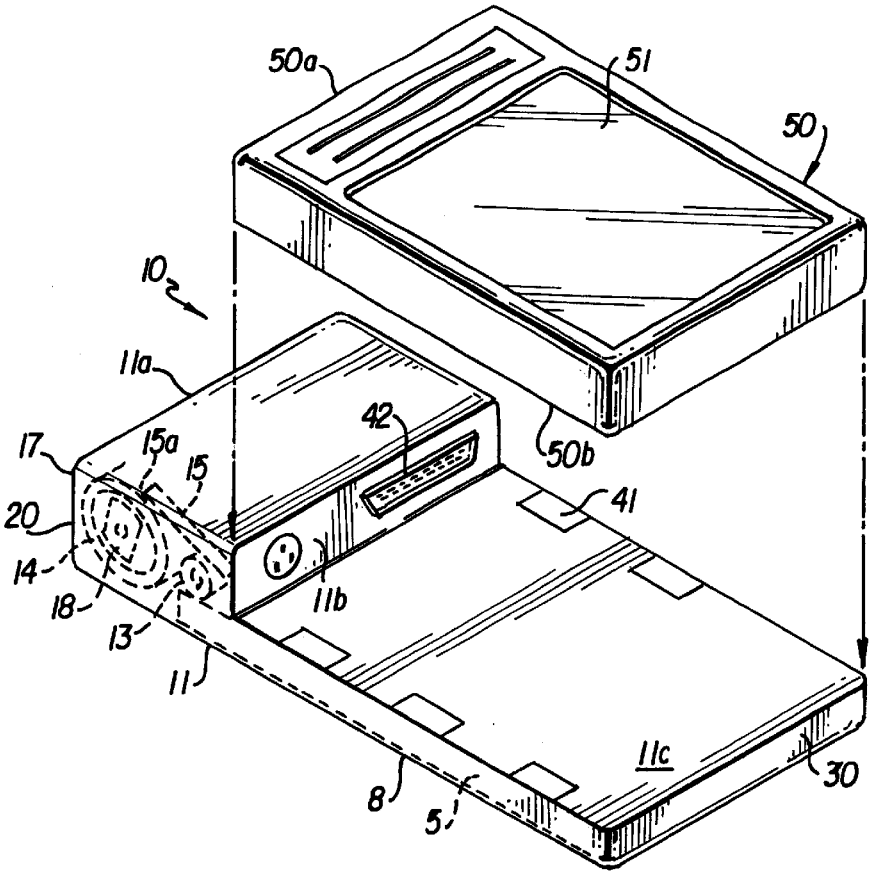
FIG. 4 is a diagram showing the printer of FIG. 1 with a PDA being detached therefrom.

FIG. 4 shows the printer 10 of the present embodiment with the PDA 50 being detached therefrom. The PDA 50 can be independently used as a portable information processor. According to the printer 10 of the present embodiment, the PDA 50 can be detached from the housing 11 containing the printing mechanism portion 20 and the paper accommodating portion 30. A plurality of fitting 41 are provided on a surface 11*c* of the housing 11 which faces the bottom surface 50*b* of the PDA 50, whereby the PDA 50 can be attached to and detached from the housing 11 by the detachable fitting 41. Moreover, a connector (interface) 42 for transmitting data from the PDA 50 to the printing mechanism portion 20 is provided on a side 11*b* of the housing 11 which faces the side 50*a* of the PDA 50. Thus, in the printer 10 of the present embodiment, the PDA 50 can be separated from the printer 10 and can also be used independently. Therefore, the printer 10 of the present embodiment can be used as a docking station of PDA for attaching and printing data stored in the independent PDA 50.

It should be understood that an integral printer wherein the housing 11 accommodates the PDA 50 could also be provided according to the present invention. In either case, when the PDA 50, the printing mechanism portion 20 and the paper accommodating portion 30 are integrated, a small, thin, and light-weight integral printer 10 having substantially the same size as that of a portable information processor can be realized.

The printer 10 also has the function of the portable information processor. The printer according to the present invention can be referred to as a portable PDA having a printing function. In this PDA, applications such as e-mail can be operated and message, image and the like can be easily and immediately printed out at any time and anywhere.

Moreover, although the printer and/or PDA 10 of the present embodiment is a practical, portable printer having substantially the same size as that of the PDA 50 itself, the printer and/or PDA 10 can print on a relatively large sheet such a size of A6 or B7. The printer 10 of the present embodiment may be somewhat less desirable in terms of image quality as compared to the large laser printer and the like that normally use the A4 or larger size sheets. However, the printer of the present embodiment has enough size to make a personal copy of an e-mail, an image and the like. Therefore, a practically small and portable printer that is useful for printing personal notes like a scratch pad, a document to be submitted and/or a document for storage can be provided. Thus, the printer 10 of the present embodiment is most suitable for use as a portable printer carried by an individual user in various locations including outdoors. Moreover, the printer 10 of the present embodiment employs a small, simple printing mechanism using thermosensible paper, whereby an inexpensive printer can be provided to the user.

Furthermore, the printer 10 of the present embodiment handles thin thermosensible sheets of standardized size such as B7, which is small as compared to the paper used in the printers like a laser printer, the entire printer 10 can be driven by a single and/or small capacity motor 18. Therefore, power consumption required for printing can be reduced. The printer 10 including the information processor such as PDA can be sufficiently driven by a battery or batteries, realizing a practically portable printer having an information processing function. In the present printer 100,a separate personal computer, consumables separately prepared such as printing paper or paper cartridge, a printer connection cable and a power supply adapter those required for usual printer are not necessary. In other words, by merely carrying the printer 10 of the present embodiment, a series of work from data processing to printing can be conducted at any time and anywhere.

Moreover, some thermosensible sheets can print multicolor images utilizing the temperature difference. Therefore, not only monochrome printing but also color printing can be conducted by the printer 10 of the present embodiment.

In the present embodiment, the sheets are directly inserted into the paper accommodating portion 30. However, packaged sheets set into, for example, a cassette may alternatively be inserted into the paper accommodating portion 30.

In addition, the cover 8 of the paper accommodating portion 30 can be pivotally opened and closed in the present embodiment. However, the present invention is not limited to this, and other types of covers such as a sliding cover may alternatively be used.

Moreover, the printer and the PDA shown in the present embodiment are in a substantially rectangular shape. However, the present invention is not limited to this, and the printer and the PDA may have various shapes such an a substantially elliptic or oval shape.

As has been described above, in the printer of the present invention, the printing mechanism portion is located adjacent to the side of the portable information processor, and the paper accommodating portion is located on the back of the information processor, so that an printer integral or to be integral with the portable information processor is obtained. As a result, a small and thin printer including an information processing function such as a PDA, suitable for portable use and capable of printing on relatively large cutform sheet can be provided. Moreover, since the printer of the present invention employs thermosensible paper, consumables such as ink are not necessary. Therefore, the size of the printer can further be reduced. Consequently, according to the present invention, a printer, which can be carried by the user as a mobile computer, and by which the user can obtain a print output at any time and anywhere, can be provided.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. In combination, an information processor having a data input surface and an oppositely disposed bottom surface and a printer for printing an image on printing paper, the printer adapted to be connected to said information processor, said printer comprising a housing having a paper accommodating housing portion and a printing mechanism housing portion located in a side-by-side relationship, said printing mechanism housing portion containing a printer mechanism, the paper accommodating housing portion having a connecting surface and an internal space adapted to contain a plurality of cutform sheets of printing paper, a pick-up roller positioned between the internal space of the paper accommodating housing portion and the printer mechanism for picking-up a sheet of printing paper contained in the internal space of the paper accommodating housing portion and feeding it to the printer mechanism, the connecting surface of the paper accommodating housing portion and the printing mechanism housing portion forming a connecting station adapted to mechanically connect the information processor to the printer and to transmit data between the information processor and the printer with the oppositely disposed bottom surface of the information processor confronting the connecting surface of the paper accommodating housing portion and with the data input surface of the information processor being outwardly disposed for inputting data when the information processor is connected in the connecting station.

2. The printer of claim 1 wherein the connecting station is a docking station and the information processor is detachably connected to the docking station.

3. The printer of claim 1 wherein the information processor is integrally and nondetachably connected to the connecting station of the printer.

4. The printer of claim 1 wherein the thickness of the printing mechanism housing portion is substantially the same as the thickness of the information processor and the paper accommodating housing portion when the information processor is connected to the printer.

5. The printer of claim 1 wherein the paper accommodating housing portion has a pivotable cover disposed opposite the connecting surface and the internal space of the paper accommodating housing portion, said cover being pivotably opened for accessing the internal space and inserting paper into the paper accommodating housing portion when the information processor is connected to the printer.

6. The printer of claim 1 wherein the printer and information processor are shaped as a rectangular parallelepiped when connected together.

7. The printer of claim 1 wherein the printer mechanism is a thermosensible printer and the cutform sheets of printing paper are thermosensible paper, said thermosensible printer comprising a thermal head disposed in the printer mechanism housing portion for printing on a sheet of the thermosensible paper, and a platen roller disposed in the printer mechanism housing portion for feeding a sheet of thermosensible paper to the thermal head.

8. The printer of claim 1 wherein the information processor comprises an LCD display and a touch panel for inputting information.

9. The printer of claim 1 wherein the mechanical connection between the printer and the information processor comprises detachable fittings on the connecting surface of the paper accommodating housing portion and the data transmitting connection between the printer and the information processor comprises a connector interface on the printing mechanism housing portion.

10. A printer for printing an image on printing paper, the printer adapted to be connected to an information processor having a data input top surface and an oppositely disposed bottom surface, said printer comprising a housing having a paper accommodating housing portion and a printing mechanism housing portion located in a side-by-side relationship, said printing mechanism housing portion containing a printer mechanism, the paper accommodating housing portion having an upper connecting surface, a bottom cover and an internal space between the upper connecting surface and the bottom cover adapted to contain a plurality of cutform sheets of printing paper, a pick-up roller positioned between the internal space of the paper accommodating housing portion and the printer mechanism for picking-up a sheet of printing paper contained in the internal space of the paper accommodating housing portion and feeding it to the printer mechanism, the upper connecting surface of the paper accommodating housing portion and the printing mechanism housing portion forming a connecting station adapted to mechanically connect the information processor to the printer and to transmit data between the information processor and the printer with the oppositely disposed bottom surface of the information processor confronting the upper connecting surface of the paper accommodating housing portion and with the data input top surface of the information processor being outwardly disposed for inputting data when the information processor is connected in the connecting station.

11. The printer of claim 10 wherein the printer mechanism is a thermosensible printer and the cutform sheets of printing paper are thermosensible paper, said thermosensible printer comprising a thermal head disposed in the printer mechanism housing portion for printing on a sheet of thermosensible paper, and a platen roller disposed in the printer mechanism housing portion for feeding a sheet of thermosensible paper to the thermal head.

12. The printer of claim 10 wherein the bottom cover of the paper accommodating housing portion comprises a pivotable cover, said pivotable cover being pivotable from a side of the paper accommodating housing portion for inserting paper into the paper accommodating housing portion.

13. In combination, an information processor having a data input surface and an oppositely disposed bottom surface and a printer for printing an image on printing paper, the printer being detachably connected to said information processor, said printer comprising a housing including a paper accommodating housing portion having an internal space with means for holding a plurality of cutform sheets of printing paper and a printing mechanism housing portion located in a side-by-side relationship with the paper accommodating housing portion, said printing mechanism housing portion containing a printer mechanism, the paper accommodating housing portion having a connecting surface, a pick-up roller positioned between the internal space of the paper accommodating housing portion and the printer mechanism for successively picking-up sheets of printing paper from the holding means and feeding such sheets successively to the printer mechanism, the connecting surface of the paper accommodating housing portion and the printing mechanism housing portion forming a docking station for mechanically and electronically connecting the information processor to the printer and for transmitting data between the information processor and the printer with the oppositely disposed bottom surface of the information processor confronting the connecting surface of the paper accommodating housing portion, the data input surface of the information processor being outwardly disposed for inputting data when the information processor is connected to the docking station, the paper accommodating housing portion having a bottom comprising a pivotable cover disposed opposite the connecting surface and being pivotably connected to the paper accommodating housing portion for accessing the internal space and inserting printing paper into the holding means when the information processor is connected to the docking station of the printer.

14. The printer of claim 13 wherein the pivotable cover of the paper accommodating housing portion is pivotable at a side of the paper accommodating housing portion opposite the printing mechanism housing portion.

* * * * *